United States Patent [19]

Lowrigkeit

[11] 4,052,131

[45] Oct. 4, 1977

[54] PAVING STONE

[76] Inventor: Paul E. Lowrigkeit, Gruner Jagerweg 11, 3146 Adendorf, Germany

[21] Appl. No.: 679,855

[22] Filed: Apr. 23, 1976

[30] Foreign Application Priority Data

Apr. 30, 1975 Germany ..... 2519225

[51] Int. Cl.[2] ..... E01C 5/00

[52] U.S. Cl. ..... 404/34

[58] Field of Search ..... 404/34, 37, 38, 39, 404/41, 42, 44, 45; 52/596, 607

[56] References Cited

U.S. PATENT DOCUMENTS

| | | | |
|---|---|---|---|
| 1,379,440 | 5/1921 | Brainerd | 404/34 |
| 1,766,561 | 6/1930 | Straub | 52/596 |
| 2,215,159 | 9/1940 | Rothmann | 404/34 |
| 2,231,780 | 2/1941 | Swenson | 404/34 |
| 2,662,343 | 12/1953 | Rice | 404/34 |

FOREIGN PATENT DOCUMENTS

| | | | |
|---|---|---|---|
| 423,828 | 12/1910 | France | 404/34 |
| 1,534,572 | 8/1969 | Germany | 404/34 |
| 1,409,791 | 10/1968 | Germany | 404/34 |
| 178,939 | 11/1935 | Switzerland | 404/34 |

*Primary Examiner*—Henry S. Jaudon
*Attorney, Agent, or Firm*—Toren, McGeady and Stanger

[57] ABSTRACT

A paving stone module in the form of a slab of substantially even thickness of a trapezoidal shape having substantially flat upper and lower surfaces, four side and end walls and a plurality of elongate apertures extending from the upper to the lower surface, the side and end walls being withdrawn inwardly toward the lower surface of the stone, the apertures being narrower at their upper ends adjacent the upper surface of the stone, and upper marginal portions of the side, end and aperture walls define projecting edges. Along two or more outer walls of the stone may be provided spacer shoulders having an abutment surface extending perpendicularly of the lower and upper surfaces of the stone.

10 Claims, 7 Drawing Figures

PAVING STONE

The present invention relates generally to pavements for the purpose of stabilizing soils with natural plant growth and particularly to a paving module or "stone" comprising a slab of substantially even thickness and having substantially planar upper and lower surfaces, four side and end walls and a plurality of elongate apertures extending from the upper surface to the lower surface of the block, the cross-section of the apertures increasing in size from the upper toward the lower surface.

Heretofore known paving modules or stones of this type were generally of a rectangular or a rhombic configuration. Rhombic shapes generally serve to enhance the grip of vehicles' wheels because the slots or interstices defined between adjacent stones do not extend in mutually parallel directions but include angles with each other across paved surface. Due to this configuration, heretofore known paving stones were restricted in their scope of application since these paving stones merely allow to lay out or pave straight-line or respectively rectangular areas on the ground.

Furthermore, it has already been suggested to provide paving stones with spacer shoulders having a rectangular outer contour. These spacer shoulders are provided in identical arrangements along opposite side walls of the paving stone so that when assembling two paving stones side to side the spacer shoulders of the adjacent paving stones will necessarily abut. This has the drawback that the supporting area in which each paving stone engages an adjacent paving stone is relatively small so that even relatively small displacements of one paving stone may have the effect of weakening and loosening the overall structure of a relatively large compound of paving stones across a paved surface.

Especially on ground areas that are liable to occasional inundation by water such as embankments of streams and the like these small supporting areas between adjacent paving stones may have the drawback of considerably enhancing washing out effects. Such washing out effects may not safely be prevented by providing the paving stones with inclined side walls. Although inclined side walls offer an increased resistance against sink-down into soft soil, the steadily increasing aperture width from top to bottom surface of the stone is not only readily susceptible to washing out effects but leads in softened soils to a wedge type effect by which the softened soil will become extruded upwardly and then washed away, with a resultant loosening of the paving stone.

Furthermore, it is likewise known to provide in paving stones apertures of certain configurations. In top view, such apertures may be restricted or narrower in their central portions, or the edges of the apertures may be undulated, all to the effect to enlarge the surface of the aperture walls. When the side walls of the apertures are inclined but otherwise of a substantially planar configuration, this configuration will tend to loosen the soil underneath the paving stone. This will in turn lead to more pronounced washing out effects, particularly under the influence of humidity or when inundated by water.

It is now an object of the present invention to provide an improved paving stone of the type stated at the outset of the present specification.

It is another object of the present invention to provide an improved paving stone that is adapted to be more firmly supported on the ground and which offers a higher resistance against eroding or washing out effects.

It is a further object of the present invention to provide an improved paving stone, a plurality of which may be laid out optionally to cover straight-line or curved strips of ground.

In accordance with the present invention, these objects are achieved by a paving stone of a substantially trapezoidal configuration including a plurality of elongate apertures extending in parallel directions to the mutually parallel side walls of the trapezoidal body. When arranging several paving stones side wall to side wall with the shorter end walls of all paving stones on one side, and the longer end walls of all stones on the opposite side, the paving stones cover an arcuate area, and when arranging several paving stones side wall to side wall with the shorter end walls of the stones alternately disposed on one side and on the opposite side with respect to the longitudinal extension of the stone assembly, the paving stones cover a substantially straight-line area. The side and end walls of the stone include a curved, roof-type projecting edge which prevents soil from being squeezed out toward the upper surface of the stone. When the paving stones sink into the ground or when loads are applied to the upper surface of the stones, the soil underneath the lower surface of the stones will be compressed and thereby become consolidated. Sods in between stones and within the apertures of the stones will thus encounter particularly favorable conditions for growing roots within the tightly compressed surface layers. Under well-watered conditions, the roof-type projecting edges prevent soil from being washed out in an upward direction. The trapezoidal configuration advantageously allows for the layout of straight-line or curved strips of ground whereby at least the joints between adjoining paving stones extend under mutually offset angles which do not only improve the grip but likewise the anchoring of the stones in the ground.

Advantageously, the walls of the apertures, as seen in cross-section, are arcuately bent inwardly toward their upper ends, and the side surfaces are curved outwardly toward their upper ends whereby the radius of curvature decreases toward the upper surface of the stone. Since the lower wall portions of the side and aperture walls extend substantially perpendicularly of the main plane of the paving stone, a stable alignment of the stones on the ground will be achieved. The outwardly or inwardly curved upper marginal portions improve considerably the load supporting capacity of the paving stone whereby these curved portions retain the soil underneath the paving stone and prevent the soil from being washed out.

In other words, lower wall portions of the side and aperture walls each include an angle of substantially 90° with the lower surface of the stone, and upper wall portions of the side and aperture walls each are arcuately shaped, the upper wall portions of the side walls being curved outwardly, and the upper wall portions of the aperture walls being curved inwardly toward the center of the aperture.

The paving stones may of course be provided with spacer shoulders, and each spacer shoulder preferably includes an outer face wall that extends perpendicularly of the main plane of the paving stone, i.e. perpendicularly of the upper and lower surfaces. This results in an even support along the shorter abutment surfaces defined by the end walls. Although spacer shoulders may be provided along all four sides of the paving stone, it is preferred to provide spacer shoulders only along the mutually inclined opposite side walls. In the trapezoidal paving stone, these side walls define the longer sides of the stone.

In a particularly preferred embodiment, the number of spacer shoulders along one of the inclined opposite side walls is different from the number of spacer shoulders along the opposite side wall, and the spacer shoulders along the two side walls are mutually offset with respect to a longitudinal center plane through the stone. This arrangement is particularly advantageous when laying out curved line stone assemblies that may be subject to lateral forces transmitted by vehicles driving over the stones. In such an arcuate pavement the spacer shoulders of one paving stone may engage the side wall of an adjoining paving stone in between the spacer shoulders in what may be termed an interlocking assembly. In straight line stone assemblies in which the junction gaps between adjoining paving stones are inclined in alternate directions with respect to the longitudinal extension of the stone assembly, the face walls of the spacer shoulders of adjacent stones engage each other in full surface engagement over the whole depth the the stones, due to the fact that these face walls extend perpendicularly of the main plane of the paving stone. In the latter arrangement, the face walls of the spacer shoulders are in full surface engagement whereas in the first-mentioned arrangement wherein the shorter end walls of the stones are alternately disposed on one side and on the opposite side only the upper marginal portions of the spacer shoulders engage the upper outwardly curved wall portions of the side walls of adjacent paving stones.

In any case, a safe mutual support of the paving stones is ensured by the fact that the spacer shoulders outer face walls extending perpendicularly of the main plane of the paving stone are also parallel to the upper marginal portions of the side walls of the trapezoidal paving stones.

The apertures of the stones may be of any desired configuration as seen in top view, and particularly the central portions of the apertures may be of a reduced width. The correspondingly resulting curvature of the aperture walls provides an extremely safe anchoring of the paving stone in the ground by strongly compressing the ground underneath the lower surface of the paving stone.

In the following the present invention will be described more in detail with reference to the embodiments shown in the appended drawings.

Figure 1:
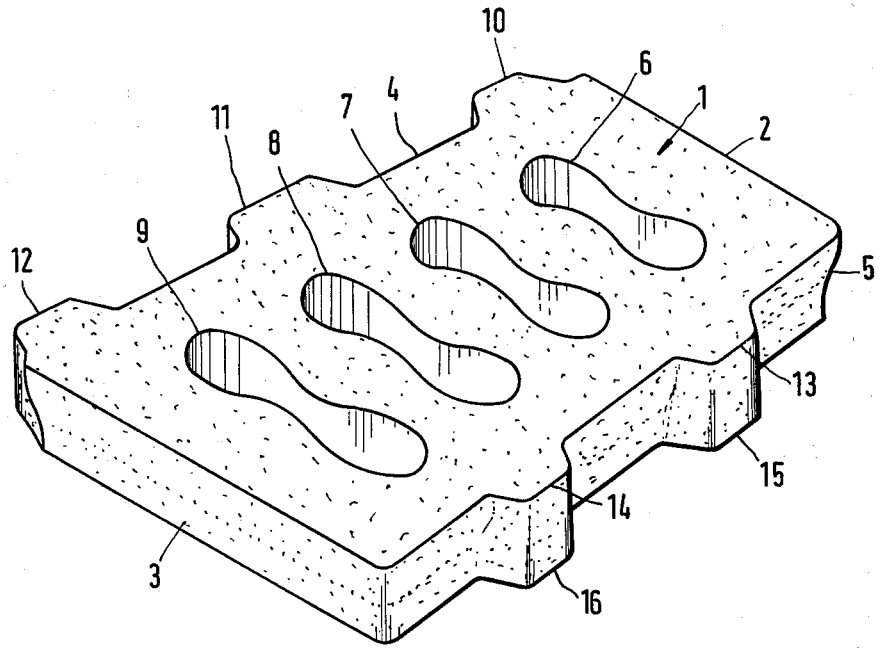
FIG. 1 is a perspective top view of one embodiment of a paving stone in accordance with the present invention.

Referring to the drawings, the paving stone 1 shown in FIG. 1 comprises a slab of substantially even thickness that is made of any suitable material. This slab is defined by substantially planar or flat upper and lower surfaces, a short end wall 2, a longer end wall 3 and a pair of slightly convergent side walls 4 and 5. These side walls 4, 5 are of equal length and longer than each of the end walls 2, 3. As will be described further below with reference to FIGS. 3 and 4, the side walls 4, 5 are curved inwardly in a downward direction, as seen best in the sectional views, so that these side walls define a roof-shaped projection along their upper portions.

Several slot-shaped apertures 6 – 9 extending from the upper surface to the lower surface of the stone are mutually spaced along the length of the stone and extend in directions parallel to the end walls 2, 3. These apertures 6 – 9 are narrower in their central portions. The walls of the apertures are likewise arcuately shaped as seen in cross-section whereby the width or respectively the length of the apertures decrease from top to bottom and the radius of curvature decreases from bottom to top.

Along the side wall 4 are provided three mutually spaced spacer shoulders 10, 11 and 12, and along the side wall 5 are provided two mutually spaced spacer shoulders 13 and 14. The spacer shoulders 13, 14 along the side wall 5 are offset with respect to the spacer shoulders 10 – 12 along the side wall 4. Each spacer shoulder includes an outer face wall such as the face walls 15 and 16 shown at the spacer shoulders 13 and 14 respectively. These face walls 15, 16 lie in planes that are parallel to the upper edges of the side walls 4, 5 and are perpendicular to the main plane of the paving stone, i.e. to the upper or the lower surface of the stone.

Figure 2:
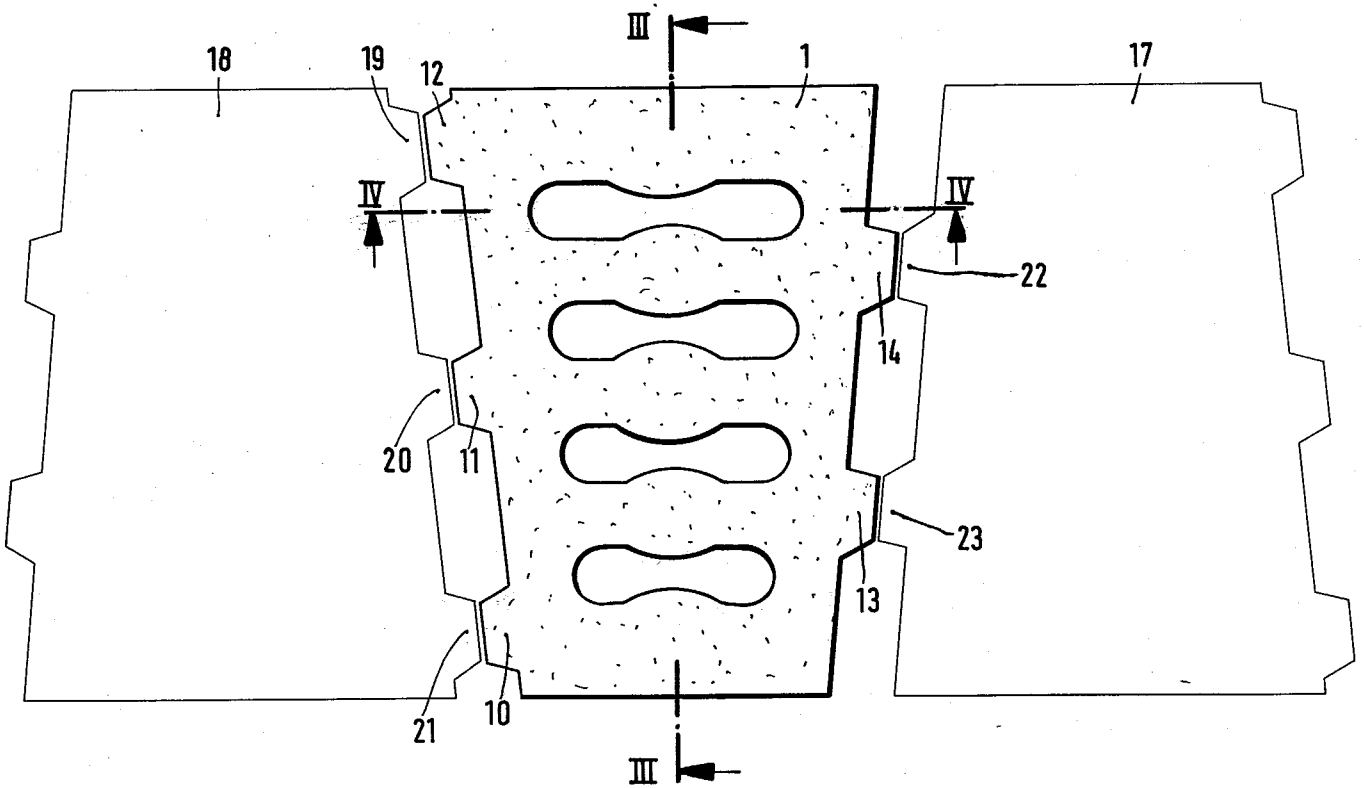
FIG. 2 is a schematical top view of a straight line assembly of three paving stones.

Referring to FIG. 2, there is shown an assembly of three paving stones 1, 17 and 18 which are each mutually offset by 180°. The spacer shoulders 10, 11, 12 of the center paving stone 1 abut the spacer shoulders 21, 20, 19 respectively of the left hand adjacent paving stone 18 whereas the spacer shoulders 13, 14 along the opposite side wall of the center paving stone 1 abut the corresponding spacer shoulders 23, 22 respectively of the right hand adjacent paving stone 17. The perpendicular face walls 15, 16 thereby abut with their whole surface against respective corresponding face walls of the engaged spacer shoulders. The assembly therefore defines a relatively rigid support. The mutually opposing paving stone side walls may of course be provided with different numbers of spacer shoulders whereby, however, the mutual offset of spacer shoulders along opposite side walls has to be correspondingly modified.

Figure 3:
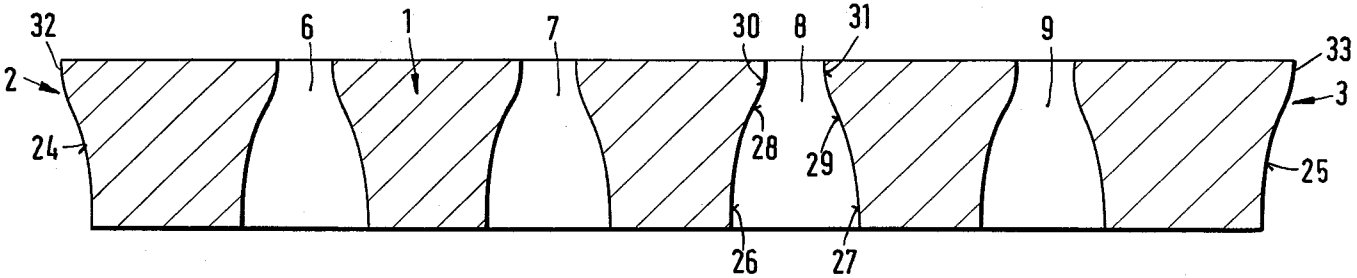
FIG. 3 is a sectional view along the line III—III of FIG. 2.

FIG. 3 is a sectional view of the paving stone 1. The configuration of the apertures 6 – 9 and of the side surfaces 24, 25 of the end walls 2, 3 respectively may be clearly seen. As demonstrated in the aperture 8, this aperture includes lower wall portions 26, 27 extending substantially perpendicularly of the main plane of the paving stone, and upper wall portions 28, 29 curved inwardly in an upward direction toward the upper surface of the stone whereby the radius of curvature decreases towards the upper surface of the stone. With this arrangement, the upper marginal portions of the aperture 8 define roof-type projecting or cantilever edges 30, 31. Similar projecting edges 32, 33 are defined at the upper marginal portions of the side surfaces 24, 25.

Figure 4:
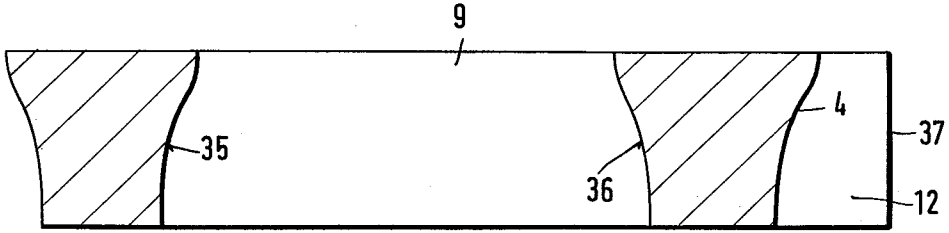
FIG. 4 is a sectional view along the line IV—IV of FIG. 2.

Referring to FIG. 4, it may be seen that the aperture end walls 35, 36 of the aperture 9 are of a similar cross-sectional configuration. In FIG. 4 is also illustrated in elevation the spacer shoulder 12 that projects outwardly from the downwardly and inwardly curved side wall 4 and defines a face wall 37 extending perpendicularly of the main plane of the paving stone.

Figure 5:
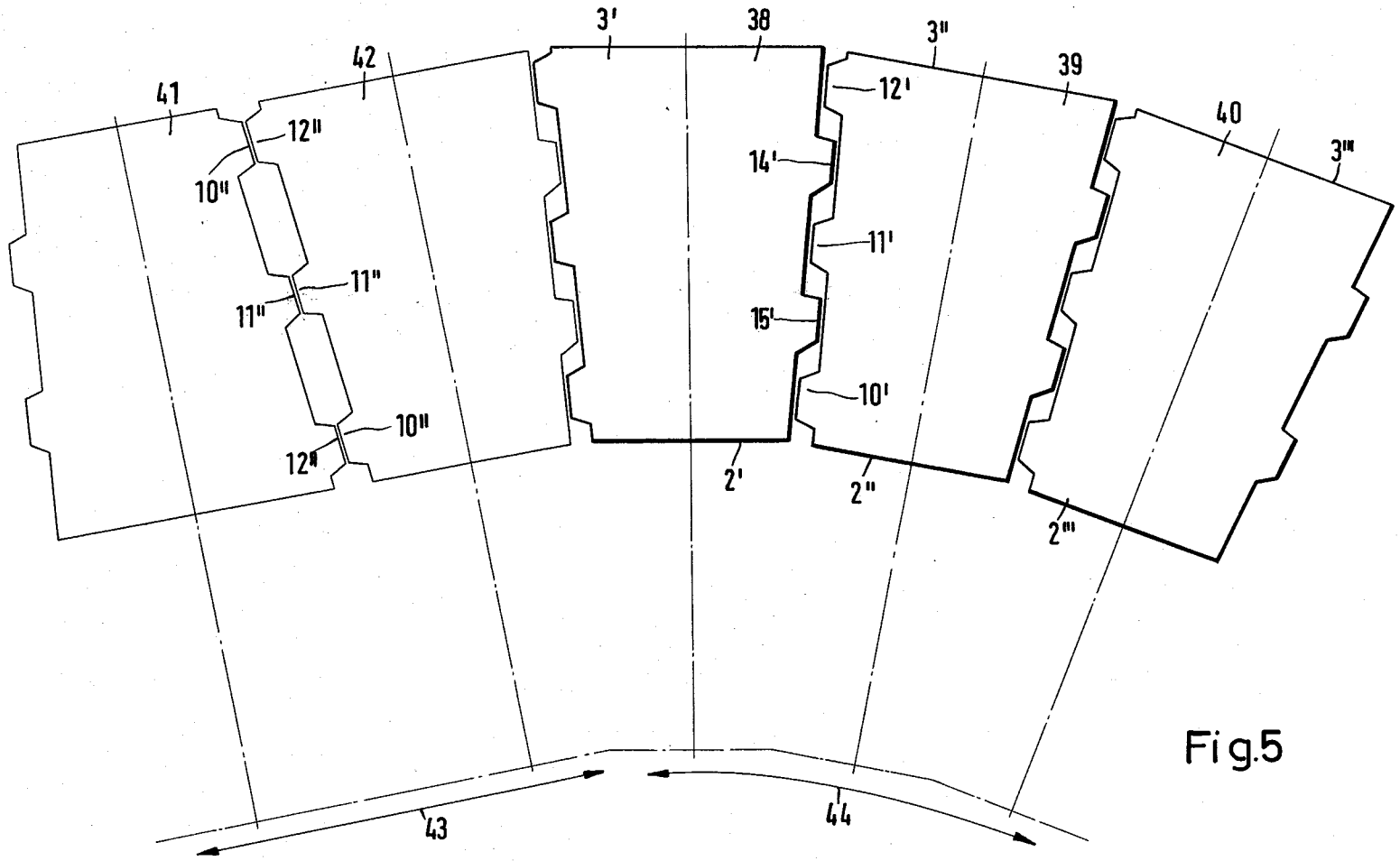
FIG. 5 is a top view of an assembly of five schematically shown paving stones for illustrating various types of arrangements.

FIG. 5 is a schematical top view of an assembly of five paving stones, only the outer contours of which are shown. Three paving stones 38, 39, 40 are disposed with their narrow end walls 2', 2'', 2''' on the one side, and their longer end walls 3', 3'', 3''' on the opposite side of the assembly. The assembly of the three stones extends along a curved line 44 whereby e.g. the spacer shoulders 14', 15' of the paving stone 38 engage the side wall of the adjoining paving stone 39 in between the spacer shoulders 10', 11', 12' thereof. The same applies to the interface between the adjoining sides of the paving stones 39, 40. This mutual engagement of the spacer shoulders may be termed "interlocking."

In the left hand portion of FIG. 5 there are shown two paving stones 41, 42 whereby the paving stone 41 is laid out "upside down" with respect to the paving stone 42, i.e. rotated through 180°. With this arrangement, a straight line stone assembly 43 may be laid out. In this assembly, the face walls of the spacer shoulders 10'', 11'', 12'' abut the face walls of the correspondingly arranged and spaced spacer shoulders 12'', 11'', 10'' of the adjoining paving stone. Since the face walls extend perpendicularly of the main plane of the paving stone, engaging face walls will be in full surface contact with each other.

As will become apparent from FIG. 5, one and the same paving stone allows for the layout of straight line pavements 43 or arcuate pavements as indicated by the line 44.

Figure 6:
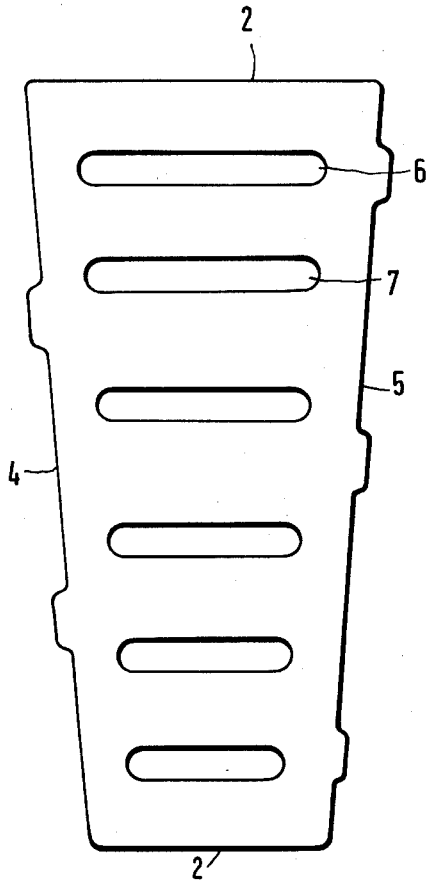
FIG. 6 is a top view of a preferred embodiment of a paving stone.

FIG. 6 shows a preferred embodiment of a paving stone in which the side walls 4, 5 are about twice as long as the longer end wall 3, and the longer end wall 3 is about one and a half times as long as the shorter end wall 2. This preferred embodiment of a paving stone is provided with six apertures 6, 7 . . . .

A paving stone of the type shown in FIG. 6 may have a longitudinal extension of about 45 in. (115 cms). A paving stone with these proportions exhibits an excellent rigidity and the thereby predetermined angles of inclination of the side walls with respect to the end walls are sufficiently great so as to allow to lay out arcuate pavements in a decorative pattern on the hand or straight line pavements on the other hand whereby in the latter arrangement is avoided the undesirable appearance of junction gaps created by gaps extending perpendicularly of the longitudinal extension of a strip of pavement.

Figure 7:
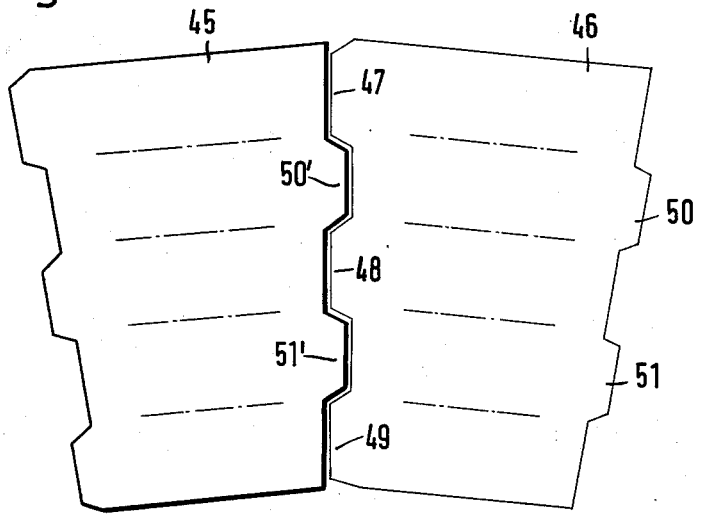
FIG. 7 is a schematical top view of an assembly of two paving stones with a particular arrangement of the spacer shoulders.

FIG. 7 shows another embodiment of a pair of paving stones 45, 46 made in accordance with the above described characteristics. In this embodiment, the spacer shoulders 47, 48, 49 and 50, 51 respectively are shaped and spaced so as to mutually interlock in arcuately laid out pavements. As may be seen in FIG. 7, the spacer shoulders 50', 51' of the paving stone 45 engage the side wall of the paving stone 46 in between the spacer shoulders 47, 48, 49 thereof.

The embodiments of the present invention in which an exclusive property or privilege is claimed are defined as follows:

1. A paving stone for stabilizing soils with natural plant growth, the paving stone comprising a slab of substantially even thickness and having substantially flat upper and lower surfaces, a pair of oppositely disposed side walls and a pair of oppositely disposed end walls, and a plurality of elongate apertures extending from the upper surface to the lower surface, the cross-section of the apertures increasing in size from the upper toward the lower surface, the side and end walls being withdrawn inwardly in downward direction toward the lower surface, said paving stone being characterized in that said slab including webs defined between adjacent apertures and the side and end walls each include an upper curved roof-type projecting edge, the walls of the apertures, as seen in cross-section, being arcuately bent inwardly toward their upper ends, and the side surfaces being curved outwardly toward their upper ends whereby the radius of curvature decreases toward the upper surface of the stone, one of said end walls is shorter than the other so that the body of the stone is of a substantially trapezoidal configuration, the end walls are parallel to each other and the elongate direction of the apertures extends parallel to the end walls so that when arranging several paving stones side wall to side wall with the shorter end walls of all stones on one side, and the longer end walls of all stones on the opposite side, the assembly of paving stones covers an arcuate area, and when arranging several paving stones side wall to side wall with the shorter end walls of the stones alternately disposed on one side and on the opposite side with respect to the longitudinal extension of the stone assembly, the paving stones cover a substantially straight-line area.

2. A paving stone as defined in claim 1, wherein lower wall portions of the side and aperture walls each include an angle of substantially 90° with the lower surface of the stone, and upper wall portions of the side and aperture walls each are arcuately shaped, the upper wall portions of the side walls being curved outwardly, and the upper wall portions of the aperture walls being curved inwardly toward the center of the aperture.

3. A paving stone as defined in claim 2, including a plurality of spacer shoulders each having an outer face wall extending perpendicularly of the main plane of the paving stone.

4. A paving stone as defined in claim 3, wherein the spacer shoulders are arranged along the mutually inclined opposite side walls of the paving stone.

5. A paving stone as defined in claim 4, wherein a first plurality of spacer shoulders is arranged along one of the inclined opposite side walls and a second plurality of spacer shoulders different from said first plurality of spacer shoulders is arranged along the other of the opposite side walls.

6. A paving stone as defined in claim 5 wherein the spacer shoulder outer face walls extending perpendicularly of the main plane of the paving stone are parallel to the upper marginal portions of the side walls of the trapezoidal paving stone.

7. A paving stone for stabilizing soils with natural plant growth, the paving stone comprising a slab of substantially even thickness and having substantially flat upper and lower surfaces, a pair of oppositely disposed side walls and a pair of oppositely disposed end walls, a plurality of elongate apertures extending from the upper surface to the lower surface, the cross-section of the apertures increasing in size from the upper toward the lower surface, the side and end walls being withdrawn inwardly in downward direction toward the lower surface, said slab including webs defined between adjacent apertures and the side and end walls each including an upper curved roof-type projecting edge, the end walls being parallel to each other and the apertures extending in the elongate direction parallel to the end walls, a first plurality of spacer shoulders arranged along one of the inclined opposite side walls and a second plurality of spacer shoulders arranged along the other of the opposite side walls, and one of said end walls being shorter than the other with the body of the stone being substantially trapezoidal so that when arranging several paving stones side wall to side wall with the shorter end walls of all stones on one side, and the longer end walls of all stones on the opposite side, the assembly of paving stones covers an arcuate area, and when arranging several paving stones side wall to side wall with the shorter end walls of the stones alternately disposed on one side and on the opposite side with respect to the longitudinal extension of the stone assembly, the paving stones cover a substantially straight-line area.

8. A paving stone as defined in claim 7, wherein the apertures are of a reduced width in their central portions.

9. A paving stone as defined in claim 7, wherein the spacer shoulders, different numbers of which are arranged along opposite side walls of a paving stone, are arranged so that the spacer shoulders of one paving stone may engage the side wall of an adjoining paving stone in between the spacer shoulders thereof whereby the spacer shoulders likewise engage each other.

10. A paving stone as defined in claim 7, wherein the side walls are of about twice the length of the longer end wall, and the longer end wall is about one and a half times as long as the shorter end wall.

* * * * *